United States Patent [19]

Jackson et al.

[11] Patent Number: 4,826,734

[45] Date of Patent: May 2, 1989

[54] TUNGSTEN CARBIDE-COBALT COATINGS FOR VARIOUS ARTICLES

[75] Inventors: John E. Jackson, Brownsburg; Robert W. Meyerhoff, Zionsville; Marianne O. Price; Jean M. Quets, both of Indianapolis, all of Ind.

[73] Assignee: Union Carbide Corporation, Danbury, Conn.

[21] Appl. No.: 163,945

[22] Filed: Mar. 3, 1988

[51] Int. Cl.[4] ..... B32B 15/04

[52] U.S. Cl. ..... 428/472; 428/698

[58] Field of Search ..... 428/698, 699, 469, 472

[56] References Cited

U.S. PATENT DOCUMENTS

| | | | |
|---|---|---|---|
| 2,714,563 | 8/1955 | Poorman et al. | 117/105 |
| 2,972,550 | 2/1961 | Pelton | 117/21 |
| 3,071,489 | 1/1963 | Pelton et al. | 117/22 |
| 3,150,828 | 9/1964 | Pelton et al. | 239/79 |
| 3,150,938 | 9/1964 | Pelton et al. | 29/194 |
| 3,773,259 | 11/1973 | Zverev | 239/81 |
| 3,801,346 | 4/1974 | Melton, Jr. et al. | 117/16 |
| 3,884,415 | 5/1975 | Zverev et al. | 239/79 |
| 3,910,494 | 10/1975 | Melton, Jr. | 239/13 |
| 4,004,735 | 1/1977 | Zverev et al. | 239/79 |
| 4,172,558 | 10/1979 | Zverev et al. | 239/85 |
| 4,215,819 | 8/1980 | Garda et al. | 239/81 |
| 4,231,518 | 11/1980 | Averev et al. | 239/81 |
| 4,258,091 | 3/1981 | Dudko et al. | 427/422 |
| 4,279,383 | 7/1981 | Zverev et al. | 239/61 |
| 4,319,715 | 3/1982 | Garda et al. | 239/81 |
| 4,359,335 | 11/1982 | Garner | 428/698 X |
| 4,469,772 | 9/1984 | Barton et al. | 430/163 |
| 4,490,191 | 12/1984 | Hale | 428/698 X |
| 4,598,016 | 7/1986 | Tuoma et al. | 428/698 X |
| 4,669,658 | 6/1987 | Nevgod et al. | 239/81 |

FOREIGN PATENT DOCUMENTS

| | | | |
|---|---|---|---|
| 2528255 | 2/1977 | Fed. Rep. of Germany | 428/698 |
| 0009366 | 1/1981 | Japan | 428/698 |
| 1358538 | 7/1974 | United Kingdom | 428/698 |

*Primary Examiner*—Nancy A. B. Swisher

*Attorney, Agent, or Firm*—Cornelius F. O'Brien

[57] ABSTRACT

The invention relates to a coated article comprising a substrate coated with a tungsten carbide-cobalt layer having a strain-to-fracture greater than $4.3 \times 10^{-3}$ inch per inch and a Vickers hardness of greater than about 875 $HV_{0.3}$.

15 Claims, No Drawings

TUNGSTEN CARBIDE-COBALT COATINGS FOR VARIOUS ARTICLES

FIELD OF THE INVENTION

The invention relates to improved tungsten carbide-cobalt coatings for various substrates in which the coated articles exhibit improved fatigue characteristics over similar articles coated with a commercial tungsten carbide-cobalt coating.

BACKGROUND OF THE INVENTION

Flame plating by means of detonation using a detonating gun (D-Gun) has been used in industry to produce coatings of various compositions for over a quarter of a century. Basically, the detonation gun consists of a fluid cooled barrel having a small inner diameter of about one inch. Generally a mixture of oxygen and acetylene is fed into the gun along with a comminuted coating material. The oxygen-acetylene fuel gas mixture is ignited to produce a detonation wave which travels down the barrel of the gun whereupon the coating material is heated and propelled out of the gun onto an article to be coated. U.S. Pat. No. 2,714,563 discloses a method and apparatus which utilizes detonation waves for flame coating. The disclosure of this U.S. Pat. No. 2,714,563 is incorporated herein by reference as if the disclosure was recited in full text in this specification.

In general, when the fuel gas mixture in a detonation gun is ignited, detonation waves are produced whereupon the comminuted coating material is accelerated to about 2400 ft/sec and heated to a temperature about its melting point. After the coating material exits the barrel of the detonation gun a pulse of nitrogen purges the barrel. This cycle is generally repeated about four to eight times a second. Control of the detonation coating is obtained principally by varying the detonation mixture of oxygen to acetylene.

In some applications, such as producing tungsten carbide-cobalt based coatings, it was found that improved coatings could be obtained by diluting the oxygen-acetylene fuel mixture with an inert gas such as nitrogen or argon. The gaseous diluent has been found to reduce or tend to reduce the flame temperature since it does not participate in the detonation reaction. U.S. Pat. No. 2,972,550 discloses the process of diluting the oxygen-acetylene fuel mixture to enable the detonation-plating process to be used with an increased number of coating compositions and also for new and more widely useful applications based on the coating obtainable. The disclosure of this U.S. Pat. No. 2,972,550 is incorporated herein by reference as if the disclosure was recited in full text in this specification.

Generally, acetylene has been used as the combustible fuel gas because it produces both temperatures and pressures greater than those obtainable from any other saturated or unsaturated hydrocarbon gas. However, for some coating applications, the temperature of combustion of an oxygen-acetylene mixture of about 1:1 atomic ratio of oxygen to carbon yields combustion products much hotter than desired. As stated above, the general procedure for compensating for the high temperature of combustion of the oxygen-acetylene fuel gas is to dilute the fuel gas mixture with an inert gas such as nitrogen or argon. Although this dilution lowers the combustion temperature, it also results in a concomitant decrease in the peak pressure of the combustion reaction. This decrease in peak pressure results in a decrease in the velocity of the coating material propelled from the barrel onto a substrate. It has been found that with an increase of a diluting inert gas to the oxygen-acetylene fuel mixture, the peak pressure of the combustion reaction decreases faster than does the combustion temperature.

In copending U.S. patent application Ser. No. 110,841, filed Oct. 21, 1987, a novel fuel-oxidant mixture for use with an apparatus for flame plating using detonation means is disclosed. Specifically, this reference discloses that the fuel-oxidant mixture for use in detonation gun applications should comprise:

(a) an oxidant and (b) a fuel mixture of at least two combustible gases selected from the group of saturated and unsaturated hydrocarbons.

The invention also relates to an improvement in a process of flame plating with a detonation gun which comprises the step of introducing desired fuel and oxidant gases into the detonation gun to form a detonatable mixture, introducing a comminuted coating material into said detonatable mixture within the gun, and detonating the fuel-oxidant mixture to impinge the coating material onto an article to be coated and in which the improvement comprises using a detonatable fuel-oxidant mixture of an oxidant and a fuel mixture of at least two combustible gases selected from the group of saturated and unsaturated hydrocarbons. The detonation gun could consist of a mixing chamber and a barrel portion so that the detonatable fuel-oxidant mixture could be introduced into the mixing and ignition chamber while a comminuted coating material is introduced into the barrel. The ignition of the fuel oxidant mixture would then produce detonation waves which travel down the barrel of the gun whereupon the comminuted coating material is heated and propelled onto a substrate. The oxidant disclosed is one selected from the group consisting of oxygen, nitrous oxide and mixtures thereof and the like and the combustible fuel mixture is at least two gases selected from the group consisting of acetylene ($C_2H_2$), propylene ($C_3H_6$), methane ($CH_4$), ethylene ($C_2H_4$), methyl acetylene ($C_3H_4$), propane ($C_3H_3$), ethane ($C_2H_6$), butadienes ($C_4H_6$), butylenes ($C_4H_8$), butanes ($C_4H_{10}$), cyclopropane ($C_3H_6$), propadiene ($C_3H_4$), cyclobutane ($C_4H_8$) and ethylene oxide ($C_2H_4O$). The preferred fuel mixture recited is acetylene gas along with at least one other combustible gas such as propylene.

Plasma coating torches are another means for producing coatings of various compositions on suitable substrates. Like the detonation gun process, the plasma coating technique is a line-of-sight process in which the coating powder is heated to near or above its melting point and accelerated by a plasma gas stream against a substrate to be coated. On impact the accelerated powder forms a coating consisting of many layers of overlapping thin lenticular particles or splats. This process is also suitable for producing tungsten carbide-cobalt based coatings.

Although good tungsten carbide cobalt based coatings can be obtained from the above processes, it is not apparent upon examining the coated articles how they will react when subjected to cyclic loading. It has been found that coated articles when subject to cyclic loading can fail due to what is called fatigue. Fatigue is the progressive phenomenon of failure that occurs in materials when they are subjected to cyclic loading at stresses having a maximum value less than the tensile strength of the materials. Fatigue can generally culminate in fracture after a sufficient number of cyclic loadings. Since fatigue causes materials to fail sooner and/or at lower loads than would be expected, its net effect has been to either shorten the useful life period of materials at the same load or reduce the allowable load for the same life period.

It is an object of the present invention to provide tungsten carbide-cobalt based coatings for various substrates such that the coated articles exhibit good fatigue characteristics.

It is another object of the present invention to provide tungsten carbide-cobalt based coatings having high strain-to fracture values that result in good fatigue characteristics for articles coated with the coatings.

It is another object of the present invention to provide an improved tungsten carbide-cobalt based coating on an article in which the coating is peened by the deposition process and which coated article exhibits improved-fatigue characteristics.

It is another object of the present invention to provide an improved tungsten carbide cobalt based coating on a substrate that has been peened so that some compressive residual stresses are introduced into the surface of the substrate and which coated article exhibits improved fatigue characteristics.

The foregoing and additional objects will become more apparent from the description and disclosure hereinafter.

SUMMARY OF THE INVENTION

The invention relates to a coated article comprising a substrate coated with a tungsten carbide cobalt based layer having a strain-to fracture of greater than $4.3\times10^{-3}$ inch per inch and a Vickers hardness of greater than 875 $HV_{0.3}$. Preferably, the strain-to-fracture should be from about $4.5\times10^{-3}$ inch per inch to $10\times10^{-3}$ inch per inch with the Vickers hardness greater than 900 $HV_{0.3}$, and most preferably. the strain-to fracture should be greater than $5.3\times10^{-3}$ with the Vickers hardness greater than 1000 $HV_{0.3}$.

The tungsten carbide-cobalt based layer should comprise from about 7 to about 20 weight percent cobalt, from about 0.5 to about 5 weight percent carbon, and from about 75 to about 92.5 weight percent tungsten. Preferably the cobalt should be from about 8 to about 18 weight percent, the carbon from about 2 to about 4 weight percent, and the tungsten from about 78 to about 90 weight percent. The most preferred coating would comprise from about 9 to about 15 weight percent cobalt, from about 2.5 to about 4.0 weight percent cobalt, and from about 81 to about 88.5 weight percent tungsten. The tungsten carbide cobalt coatings of this invention are ideally suited for coating substrates made of materials such as titanium, steel, aluminum, nickel, cobalt, alloys thereof and the like.

The tungsten carbide cobalt coating material for the invention could include a minimum amount of chromium up to 6 weight percent, preferably from about 3 to about 5 weight percent and most preferably about 4 weight percent. The addition of chromium is to improve the corrosion characteristics of the coating.

The powders of the coating material for use in obtaining the coated layer are preferably powders made by the cast and crushed process. In this process, the constituents of the powders are melted and cast into a shell-shaped ingot. Subsequently, this ingot is crushed to obtain the desired particle size distribution.

The resulting powder particles contain angular carbides of varying size. Varying amounts of metallic phase are associated with each particle. This morphology causes the individual particles to have non-uniform melting characteristics. In fact, under some coating conditions some of the particles containing some of the larger angular carbides may not melt at all.

The preferred powder produces a coating having a polished metallographic appearance consisting of approximately 2–20% angular WC particles, generally in the 1–25 micron size range, distributed in a matrix consisting of $W_2C$, mixed carbides such as $Co_3W_3C$, and Co phases.

The substrate can be peened to impart or produce residual compressive stresses in the substrate. This will effectively improve the fatigue characteristics of the article since the article can be subjected to more cyclic loading in tension before it will fail. This is due to the fact that the initial cyclic loading in tension to the article will have to reduce the residual compression stress in the substrate to zero before it imparts any tensile stress in the substrate.

The strain-to-fracture of the coatings in the examples was determined using a four point bend test. Specifically, a beam of rectangular cross-section made of 4140 steel hardened to 40–45 HRC is coated with the material to be tested. The typical substrate dimensions are 0.50 inch wide, 0.25 inch thick and 10 inches long. The coating area is 0.50 inch by 6 inches, and is centered along the 10 inch length of the substrate. The coating thickness is typically 0.015 inch, although the applicability of the test is not affected by the coating thickness in the range between 0.010 to 0.020 inch. An acoustic transducer is attached to the sample, using a couplant such as Dow Corning high vacuum grease, and masking tape. The acoustic transducer is piezoelectric, and has a frequency response band width of 90–640 kHz. The transducer is attached to a preamplifier with a fixed gain of 40 dB which passes the signal to an amplifier with its gain set at 30 dB. Thus the total system gain is 70 dB. The amplifier is attached to a counter which counts the number of times the signal exceeds a threshold value of 1 millivolt, and outputs a voltage proportional to the total counts. In addition, a signal proportional to the peak amplitude of an event is also recorded.

The coated beam is placed in a bending fixture. The bending fixture is designed to load the beam in four point bending. The outer loading points are 8 inches apart on one side of the beam, while the middle points of loading are $2\frac{3}{4}$ inches apart on the opposite side of the substrate. This test geometry places the middle $2\frac{3}{4}$ inches of the coated beam in a uniform stress state. A universal test machine is used to displace the two sets of loading points relative to each other, resulting in bending of the test sample at the center. The sample is bent so that the coating is convex, i.e., the coating is placed in tension. During bending the deformation of the sample is monitored by either a load cell attached to the universal test machine or a strain gage attached to the sample. If the load is measured, engineering beam theory is used to calculate the strain in the coating. During bending, the acoustic counts and peak amplitude are also recorded. The data are simultaneously collected with a three pen chart recorder and a computer. When cracking of the coating occurs, it is accompanied by acoustic emission. The signature of acoustic emission associated with through-thickness cracking includes about $10^4$ counts per event and a peak amplitude of 100 dB relative to 1 millivolt at the transducer. The strain present when cracking begins is recorded as the strain-to-fracture of the coating.

The residual stress of the coatings in the examples was determined using a blind hole test. The specific procedure is a modified version of ASTM Standard E-387. Specifically, a strain gage rosette is glued onto the sample to be tested. The rosette used is sold by Texas Measurements, College Station, Tex., and is gage #FRS-2. This device consists of three gages oriented at 0, 90 and 225 degrees to each other and mounted on a foil backing. The centerline diameter of the gages is 5.12 mm (0.202 in), the gage length is 1.5 mm (0.059 in), and the gage width is 1.4 mm (0.055 in). The procedure to attach the rosette to the sample is as recommended in Bulletin B-127-9 published by Measurements Group Inc., Raleigh, N.C. A metal mask is glued onto the strain gage to help position the hole at the time of drilling. The mask has an annular geometry, having an outer diameter equal to 0 382 inch, an inner diameter equal to 0.160 inch, and a thickness of 0.0485 inch. This mask is positioned to be concentric with the strain gages, using a microscope at 6×. When it is centered, a drop of glue is applied at the edges and allowed to dry, fixing the mask in place. The three gages are hooked up to three identical signal conditioners, which provide a reading in units of strain. Prior to starting a test, all three units are adjusted to give zero readings.

The test equipment includes a rotating grit blast nozzle mounted on a plate which can travel vertically and in one direction horizontally. The grit blast nozzle is made by S.S. White of Piscataway, N.J., and has an inner diameter of 0.026 inch and an outer diameter of 0.076 inch. The nozzle is offset from its center of rotation, so the result is a trepanned hole of diameter 0.096 inch. The sample to be drilled is placed in the cabinet, and the strain gage is centered under the rotating nozzle. Positioning of the part is accomplished by rotating the nozzle with no flow of either abrasive media or air, and manually adjusting the location of the sample so that the nozzle rotation is concentric with the mask. The standoff between the nozzle and the part is set at 0.020 inch. The location of the plate is marked by stops. The abrasive used to drill the holes is 27 micron alumina, carried in air at 60 psi. The erodent or abrasive media is used at a rate of 25 grams per minute (gpm). The abrasive is dispensed by a conventional powder dispenser. The hole is drilled for 30 seconds, at which time the flow of the abrasive and air is stopped. The nozzle is moved away from the part. The positions of the top of the strain gage and the bottom of the hole are measured with a portable focusing microscope and the difference recorded. The depth is the difference minus the thickness of the strain gage. The strain released around the hole is indicated by the signal conditioners, and these values are also recorded. The sample is not moved during the recording of the data, so the nozzle can be brought back to its initial starting point and the test continued.

The test is repeated until the hole depth is greater than the thickness of the coating, at which time the test is terminated. The strain released in an incremental layer at a given hole depth is related to the stress in that layer empirically, using data from a calibration sample of mild steel loaded to a known stress state. From this data the residual stress is determined.

The correlation between the strain-to-fracture and the residual stress of a coating is as follows. When a material is under a combined set of loads, the stresses and strains from each of the loading conditions may be calculated, and the total stress and strain map may be determined by superimposing the stresses resulting from each load. Applying this fact to coatings, the residual stress in the coating must be added to the stress applied during the four point bend test to determine the actual stress state of the coating at the time that fracture occurs. The four point bend test is run such that the coating is placed in tension. Thus, using the fact that stress and strain are related by a constant, the total stress in a coating at failure is actually given by $$\sigma_t = E\epsilon_f + \sigma_r \qquad \text{(eq. 1)}$$

$\sigma_t$ = total stress
E = coating elastic modulus
$\epsilon_f$ = strain-to-fracture from four point bend test
$\sigma_r$ = coating residual stress, measured from blind hole test (by convention compressive stresses are negative values)

In general, the coating will crack at a constant value of stress, regardless of whether that stress came about as a result of residual or applied stress or a combination of the two. A coating with a given compressive residual stress must be subjected to an equal amount of applied tensile stress before the coating is placed in tension. Rearranging eq. 1 to express the strain-to-fracture as a function of residual stress, it is apparent that an increased compressive stress in a coating will result in an increased strain-to-fracture of the coating.

$$\epsilon_f = \frac{(\sigma_t - \sigma_r)}{E} \qquad \text{(eq. 2)}$$

Thus, the stress or strain which can be applied before the coating fractures is affected by the amount of residual stress or strain present in the coating.

Additional information on the blind hole test for measuring residual stress can be found in the publication titled Residual Stress in Design, Process and Materials Selection, published by ASM International, Metals Park, Ohio. This publication contains an article given by L. C. Cox at the ASM Conference of the same title on Apr. 27–29, 1987 in Cincinnati, Ohio. The disclosure of this article is incorporated herein as if the entire article was presented in this specification.

In the examples, the fatigue life of tungsten carbide-cobalt based coated titanium substrates were determined. Test bars of cylindrical section were made from Ti-6Al-4V. The bars were about 3.5 inches long and threaded at both ends for about 0.8 inch. The threaded lengths had a diameter of about 0.63 inch. Each gage section was 0.250 inch diameter by 0.75 inch long. One inch radius transition sections connected both ends of each gage section to the threaded ends. The entire gage section of each bar was coated with a tungsten-carbide based coating along with a portion of the transition sections adjacent to the gage section.

Fatigue testing was conducted at room temperature by applying a cyclic tensile stress axially with ratio of the minimum to maximum stress of 0.1. In this testing, an individual bar is loaded with a cyclic tensile stress until either the bar breaks or $10^7$ cycles are completed. Different bars are loaded to different stress values until several sets of data are obtained. Some bars with high stress levels break before $10^7$ cycles and other bars with low stress levels do not break before $10^7$ cycles. A plot of the stress versus the number of cycles to failure was constructed by drawing a line through the data points. The point on the line at $10^7$ cycles is defined as the run out stress and indicates the maximum stress that the test bar can withstand and still endure at $10^7$ cycles.

Some examples are provided below to illustrate the present invention. In these examples, coatings were made using the following powder compositions shown in Table 1.

TABLE 1

| Sample Powder | Coating Material Powders: Composition - wt % Co | C | Fe | Other | W | Powder Size: % thru Mesh* | Max. % of Min. size |
|---|---|---|---|---|---|---|---|
| A Cast & Crushed | 9.0 to 10.0 | 4.3 to 4.8 | 1.5 max | 0.3 max | Bal. | 95% thru 325 | 10% less than 5 microns |
| B Cast & Crushed | 10 to 12 | 3.9% to 4.3 | 2.0 max | 0.2 max | Bal. | 98% thru 325 | 10% less than 5 microns |

*U.S. Standard Mesh size.

EXAMPLE 1

The gaseous fuel oxidant mixtures of the compositions shown in Table 2 were each introduced to a detonation gun to form a detonatable mixture having an oxygen to carbon atomic ratio as shown in Table 2. Sample coating powder A was also fed into the detonation gun. The flow rate of each gaseous fuel-oxidant mixture was 13.5 cubic feet per minute (cfm) and the feed rate of each coating powder was 53.3 grams per minute (gpm). The gaseous fuel-mixture in volume percent and the atomic ratio of oxygen to carbon for each coating example are shown in Table 2. The coating sample powder was fed into the detonation gun at the same time as the gaseous fuel-oxidant mixture. The detonation gun was fired at a rate of about 8 times per second and the coating powder in the detonation gun was impinged onto a steel substrate to form a dense, adherent coating of shaped microscopic leaves interlocking and overlapping with each other.

The percent by weight of the cobalt and carbon in the coated layer were determined along with the hardness of the coating. The hardnesses of most of the coating examples in Table 2 were measured using a Rockwell superficial hardness tester and Rockwell hardness numbers were converted into Vickers hardness numbers. The Rockwell superficial hardness method employed is per ASTM standard method E-18. The hardness is measured on a smooth and flat surface of the coating itself deposited on a hardened steel substrate. The Rockwell hardness numbers were converted into Vickers hardness numbers by the following formula: $HV_{0.3} = -1774 + 37.433$ HR45N where $HV_{0.3}$ designates a Vickers hardness obtained with 0.3 kgf load and HR45N designates the Rockwell superficial hardness obtained on the N scale with a diamond penetrator and a 45 kgf load.

The strain-to-fracture values and the residual stress values were obtained as described above and the data obtained are shown in Table 2. As evident from this data, all the coatings provided the characteristics of the subject invention which is expressed in a strain-to-fracture greater than $4.3 \times 10^{-3}$ inch per inch and Vickers hardness of greater than 875 $HV_{0.3}$. All of the tungsten carbide-cobalt coatings were obtained using an oxidant and a fuel mixture of at least two combustible gases in the detonation gun process.

TABLE 2

D-GUN PARAMETERS AND PROPERTIES OF COATINGS MADE FROM POWDER A

| Sample Coating | Gaseous Fuel-Mixture (Vol %) $C_3H_6$ | $C_2H_2$ | $O_2$ | $O_2$ to C Atomic Ratio | Hardness[1] Vickers (kg/mm²) | Chemistry % Co | % C | Strain-to-Fracture (mils/in.) | Residual Stress (KSI) |
|---|---|---|---|---|---|---|---|---|---|
| 1 | 37.0 | 3.7 | 59.3 | 1.0 | 1130 | 19.1 | 3.5 | 6.9 | −26 |
| 2 | 29.8 | 12.8 | 57.4 | 1.0 | 1185 | 17.0 | 3.1 | 6.3 | −48 |
| 3 | 29.8 | 10.0 | 60.2 | 1.1 | 1185 | 15.6 | 2.3 | 6.9 | |
| 4 | 29.8 | 7.5 | 62.7 | 1.2 | 1160 | 14.3 | 1.8 | 6.8 | −48 |
| 5 | 29.8 | 5.3 | 64.9 | 1.3 | 1145 | 13.3 | 1.6 | 6.6 | −50 |
| 6 | 29.8 | 3.2 | 67.0 | 1.4 | 1135 | 12.8 | 1.3 | 6.4 | −58 |
| 7 | 25.6 | 18.0 | 56.4 | 1.0 | 1225 | 16.7 | 3.5 | 5.4 | −65 |
| 8 | 25.6 | 16.6 | 57.8 | 1.05 | 1210 | 14.1 | 2.8 | 5.9 | −61 |
| 9 | 25.6 | 15.3 | 59.1 | 1.1 | 1225 | 13.6 | 2.1 | 6.0 | −65 |
| 10 | 25.6 | 12.9 | 61.5 | 1.2 | 1190 | 12.8 | 1.6 | 6.5 | −91 |
| 11 | 25.6 | 10.6 | 63.8 | 1.3 | 1185 | 11.4 | 1.4 | 6.1 | −44 |
| 12 | 25.6 | 8.6 | 65.8 | 1.4 | 1160 | 11.0 | 1.2 | 5.9 | −44 |
| 13 | 25.6 | 6.7 | 67.7 | 1.5 | 1145 | 10.6 | 1.0 | 6.1 | −49 |
| 14 | 25.6 | 5.7 | 68.7 | 1.6 | 1120 | 10.7 | 1.0 | 5.1 | −37 |
| 15 | 25.6 | 3.4 | 71.0 | 1.7 | 1110 | 10.3 | 0.9 | 5.2 | −45 |
| 16 | 18.6 | 26.7 | 54.7 | 1.0 | 1220 | 14.2 | 3.6 | 5.0 | −21 |
| 17 | 18.6 | 24.1 | 57.3 | 1.1 | 1240 | 11.3 | 2.2 | 4.9 | −43 |
| 18 | 18.6 | 21.8 | 59.6 | 1.2 | 1180 | 10.1 | 1.6 | 5.0 | −44 |
| 19 | 18.6 | 17.6 | 63.8 | 1.4 | 1195 | 8.0 | 0.9 | 5.1 | −51 |
| 20 | 18.6 | 14.1 | 67.3 | 1.6 | 1110 | 7.8 | 0.6 | 5.2 | −62 |

[1]Measured as Rockwell superficial hardness and converted to Vickers hardness.

EXAMPLE 2

The gaseous fuel-oxidant mixture of the compositions shown in Table 3 were each introduced into a detonation gun at a flow rate, powder feed rate, and an atomic ratio of oxygen to carbon as shown in Table 3. The coating powder was Sample A. As in Example 1, the Vickers hardness, strain-to-fracture and residual stress data were determined and these data are shown in Table 3. The hardnesses of the coatings of lines 1 and 7 through 16 in Table 3 were measured directly on a Vickers hardness tester. The Vickers hardness method employed is essentially per ASTM standard method E-384, with the exception that only one diagonal of the square indentation was measured rather than measuring and averaging the lengths of both diagonals. A load of 0.3 kgf was used ($HV_{0.3}$).

The detonation gun process in this example used nitrogen as a diluent gas. Using the conventional detonation process with an amount of nitrogen of 45 volume percent or less at a conventional flow rate of 11 to 13.5 cubic feet per minute (cfm) and powder feed rate of 53.3 grams per minute (gpm) did not produce a tungsten carbide-cobalt coating having a strain-to-fracture value of $4.3\times10^{-3}$ inch per inch or above. However when the nitrogen was increased to above 45 volume percent and/or the powder feed rate was sufficiently lowered, a tungsten carbide-cobalt coating having the required strain-to-fracture value of above $4.3\times10^{-3}$ inch per inch was obtained. This was unexpected since nitrogen in excess of 45 volume percent and/or sufficiently lower powder feed rates are not conventionally employed in commercial practice.

TABLE 3

D-GUN PARAMETERS AND PROPERTIES OF COATINGS MADE FROM POWDER A

| Sample Coating | Powder Feed Rate (gpm) | Flow Rate $ft^3$/min | Gaseous Fuel-Mixture (Vol %) $N_2$ | $C_2H_2$ | $O_2$ | $O_2$ to C Atomic Ratio | Hardness(1) Vickers ($kg/mm^2$) | Chemistry % Co | % C | Strain-To-Fracture (mils/in.) | Residual Stress (KSI) |
|---|---|---|---|---|---|---|---|---|---|---|---|
| 1 | 53.3 | 13.5 | 45 | 27.8 | 27.2 | 0.98 | 1140* | 13.6 | 3.6 | 3.0 | −3 |
| 2 | 53.3 | 13.5 | 45 | 27.5 | 27.5 | 1.0 | 1030 | 13.6 | 3.5 | 2.5 | +2 |
| 3 | 53.3 | 13.5 | 45 | 25.0 | 30.0 | 1.2 | 1009 | 11.4 | 2.1 | 2.8 | — |
| 4 | 53.3 | 13.5 | 45 | 22.9 | 32.1 | 1.4 | 991 | 11.2 | 1.6 | 2.9 | +6 |
| 5 | 53.3 | 13.5 | 45 | 21.2 | 33.8 | 1.6 | 883 | 10.9 | 1.2 | 3.3 | — |
| 6 | 53.3 | 13.5 | 45 | 19.6 | 35.4 | 1.8 | 930 | 10.6 | 1.1 | 3.3 | −1 |
| 7 | 53.3 | 11.0 | 40 | 30.3 | 29.7 | 0.98 | 1080* | 13.2 | 3.5 | 2.6 | −7 |
| 8 | 46.7 | 11.0 | 30 | 35.3 | 34.7 | 0.98 | 1150* | 10.7 | 3.6 | 2.1 | 0 |
| 9 | 40.0 | 11.0 | 10 | 42.8 | 42.2 | 0.98 | 1300* | 6.8 | 3.7 | 1.2 | −16 |
| 10 | 33.0 | 13.5 | 45 | 27.8 | 27.2 | 0.98 | 1130* | 14.8 | 3.5 | 3.4 | −18 |
| 11 | 16.0 | 13.5 | 45 | 27.8 | 27.2 | 0.98 | 1150* | 14.2 | 3.5 | 4.9 | −47 |
| 12 | 53.3 | 13.5 | 55 | 22.7 | 22.3 | 0.98 | 940* | 16.5 | 3.5 | 4.2 | −10 |
| 13 | 33 | 13.5 | 55 | 22.7 | 22.3 | 0.98 | 1000* | 16.5 | 3.4 | 4.4 | −30 |
| 14 | 17 | 13.5 | 55 | 22.7 | 22.3 | 0.98 | 970* | 17.6 | 3.3 | 5.9 | −50 |
| 15 | 53 | 13.5 | 60 | 20.2 | 19.8 | 0.98 | 880* | 18.1 | 3.4 | 4.5 | −48 |
| 16 | 33 | 13.5 | 60 | 20.2 | 19.8 | 0.98 | 880* | 18.6 | 3.4 | 5.3 | −36 |

Note (1) measured as Rockwell superficial hardness and converted to Vickers hardness unless otherwise indicated by an asterisk (*).

EXAMPLE 3

The gaseous fuel-oxidant mixtures of the compositions shown in Table 4 were each introduced into a detonation gun at a flow rate of 13.5 cubic feet per minute to form a detonatable mixture having an atomic ratio of oxygen to carbon as also shown in Table 4. The coating powder was Sample A and the fuel oxidant mixtures and powder feed rates are as also shown in Table 4. As in Example 1, the Vickers hardness, strain-to-fracture and residual stress were determined and these data are shown in Table 4. As evidenced from the data, not all the gaseous mixtures will produce tungsten carbide-cobalt coatings having the defined strain-to-fracture of greater than $4.3\times10^{-3}$ inch per inch with a Vickers hardness of greater than 875 $HV_{0.3}$. For example, the gaseous mixtures containing $CH_4$ or $C_4H_{10}$ did not produce a tungsten carbide-cobalt coating of this invention.

TABLE 4

D-GUN PARAMETERS AND PROPERTIES OF COATINGS MADE FROM POWDER A

| Sample Coating | Gaseous Fuel-Mixture (Vol %) | | | | $O_2$ to C Atomic Ratio | Powder Feed Rate (gpm) | Hardness Vickers ($kg/mm^2$) | Chemistry % Co | % C | Strain-to-Fracture (mils/in) | Residual Stress (KSI) |
|---|---|---|---|---|---|---|---|---|---|---|---|
| | $CH_4$ | $C_2H_2$ | $O_2$ | $N_2$ | | | | | | | |
| 1 | 12.9 | 40.3 | 46.8 | — | 1.0 | 53 | 1272 | 9.3 | 3.6 | 2.1 | −4.7 |
| 2 | 21.2 | 34.1 | 44.7 | — | 1.0 | 53 | 1231 | 12.6 | 3.4 | 3.4 | −27.0 |
| | $C_2H_4$ | $C_2H_2$ | $O_2$ | $N_2$ | | | | | | | |
| 3 | 17.1 | 32.9 | 50.0 | — | 1.0 | 53 | 1270 | 9.6 | 3.7 | 2.2 | −5.1 |
| 4 | 29.2 | 20.8 | 50.0 | — | 1.0 | 53 | 1186 | 13.6 | 3.7 | 4.2 | −17.8 |
| 5 | 39.2 | 10.8 | 50.0 | — | 1.0 | 53 | 1160 | 16.5 | 3.8 | 5.0 | −45.2 |
| 6 | 39.2 | 10.8 | 50.0 | — | 1.0 | 40 | 1192 | 17.3 | 3.6 | 5.6 | −57.2 |
| | $C_3H_6$ | $C_2H_2$ | $O_2$ | $N_2$ | | | | | | | |
| 7 | 17.1 | 19.6 | 45.0 | 18.3 | 1.0 | 53 | 1120 | 16.2 | 3.5 | 5.1 | −37 |
| 8 | 18.6 | 27 | 54.4 | — | 0.99 | 40 | 1160 | 14.5 | 3.7 | 6.0 | −40 |
| 9 | 25.6 | 18 | 56.4 | — | 1.0 | 53 | 1150 | 16.7 | 3.9 | 5.4 | −71 |
| 10 | 25.6 | 18 | 56.4 | — | 1.0 | 40 | 1190 | 16.4 | 3.5 | 5.2 | −81 |
| 11 | 29.8 | 12.8 | 57.5 | — | 1.0 | 53 | 1160 | 17.2 | 3.8 | 6.4 | −79 |
| | $C_3H_8$ | $C_2H_2$ | $O_2$ | $N_2$ | | | | | | | |
| 12 | 7.0 | 41.2 | 51.8 | — | 1 | 53 | 1240 | 9.5 | 3.8 | 3.1 | −31.2 |

TABLE 4-continued

D-GUN PARAMETERS AND PROPERTIES OF COATINGS MADE FROM POWDER A

| Sample Coating | Gaseous Fuel-Mixture (Vol %) | | | | $O_2$ to C Atomic Ratio | Powder Feed Rate (gpm) | Hardness Vickers ($kg/mm^2$) | Chemistry % Co | Chemistry % C | Strain-to-Fracture (mils/in) | Residual Stress (KSI) |
|---|---|---|---|---|---|---|---|---|---|---|---|
| 13 | 12.3 | 34.6 | 53.1 | — | 1 | 53 | 1196 | 13.3 | 3.8 | 4.5 | −45.9 |
| 14 | 16.8 | 29.0 | 54.2 | — | 1 | 53 | 1140 | 16.6 | 3.7 | 6.3 | −75.5 |
| 15 | 16.8 | 29.0 | 54.2 | — | 1 | 40 | 1161 | 16.9 | 3.6 | 6.0 | −91.0 |
| | $C_4H_{10}$ | $C_2H_2$ | $O_2$ | $N_2$ | | | | | | | |
| 16 | 5.7 | 41.5 | 52.9 | — | 1 | 53 | 1263 | 9.5 | 3.8 | 2.8 | −20.8 |
| 17 | 10 | 35.0 | 55.0 | — | 1 | 53 | 1277 | 8.4 | 2.2 | 3.8 | −32.6 |

EXAMPLE 4

The gaseous fuel oxidant mixtures of the compositions shown in Table 5 were each introduced into a detonation gun to form a detonatable mixture having an atomic ratio of oxygen to carbon as also shown in Table 5. The coating powder was sample B and the fuel-oxidant mixture is as also shown in Table 5. The gas flow rate was 13.5 cubic feet per minute (cfm) except for sample coatings 17, 18 and 19 which were 11.0 cfm, and the feed rate was 46.7 grams per minute (gpm). As in Examples 1 and 2, the Vickers hardness, strain to fracture and residual stress were determined and these data are shown in Table 5. The data show that tungsten carbide-cobalt coatings can be produced using the powder composition B in a detonation gun process employing an oxidant and a fuel mixture of at least two combustible gases to yield a coating having a strain-to-fracture value of greater than $4.3\times10^{-3}$ inch per inch with a Vickers hardness value of greater than 875 $HV_{0.3}$.

The gas flow rate in cubic feet per minute (cfm) and the feed rate in grams per minute (gpm) are as shown in Table 6. As in Example 1, the Vickers hardness, strain-to-fracture and residual stress were determined and these data are shown in Table 6. In addition, the run-out stress at $10^7$ cycles was also determined using the procedure described above in which a 3.5 inch long cylindrical bar of Ti-6Al-4V was coated with the sample powders.

In a second set of cylindrical bars, the bars before being coated were peened to an Almen intensity of 3A as outlined in the SAE Manual on Shot Peening, AMS 2430 and MIL S-13165. The peened coated bars were then subjected to the same type of cyclic tensile stress. The data for the run-out stress at $10^7$ cycles for the unpeened coated bars and peened coated bars are shown in Table 6.

The data in Table 6 show that in only some instances can tungsten carbide-cobalt coatings be produced having the defined strain-to-fracture greater than $4.3\times10^{-3}$ inch per inch along with a Vickers hardness of greater than 875 $HV_{0.3}$. In addition, the peening of the bar prior to coating resulted in a higher run-out stress at $10^7$ cycles over the unpeened coated bar. As evident from the data, as the strain-to-fracture increases, the run out stress also increases with sample coating 4 exhibiting run-out stresses comparable to those of the uncoated bars, peened and unpeened, respectively.

TABLE 5

D-GUN PARAMETERS AND PROPERTIES OF COATINGS MADE FROM POWDER B

| Sample Coating | Gaseous Fuel-Mixture (Vol %) $C_3H_6$ | $C_2H_2$ | $O_2$ | $N_2$ | $O_2$ to C Atomic Ratio | Hardness(1) Vickers ($kg/mm^2$) | Chemistry % Co | Chemistry % C | Strain-to-Fracture (mils/in) | Residual Stress (KSI) |
|---|---|---|---|---|---|---|---|---|---|---|
| 1 | 29.8 | 12.8 | 57.4 | — | 1.0 | 1235 | 15.2 | 2.4 | 6.3 | −106 |
| 2 | 29.8 | 7.5 | 62.7 | — | 1.2 | 1200 | 13.2 | 0.9 | 7.1 | −93 |
| 3 | 29.8 | 3.2 | 67.0 | — | 1.4 | 1180 | 11.6 | 0.6 | 7.0 | −79 |
| 4 | 25.6 | 18.0 | 56.4 | — | 1.0 | 1250 | 15.5 | 3.2 | 6.0 | −62 |
| 5 | 25.6 | 16.6 | 57.8 | — | 1.05 | 1230 | 14.3 | 2.1 | 6.8 | −26 |
| 6 | 25.6 | 15.3 | 59.1 | — | 1.1 | 1185 | 13.7 | 1.6 | 8.2 | — |
| 7 | 25.6 | 12.9 | 61.5 | — | 1.2 | 1110 | 12.6 | 1.0 | 8.0 | −87 |
| 8 | 25.6 | 10.6 | 63.8 | — | 1.3 | 1215 | 11.5 | 0.7 | 7.4 | −133 |
| 9 | 25.6 | 8.6 | 65.8 | — | 1.4 | 1020 | 10.5 | 0.7 | 6.5 | −66 |
| 10 | 25.6 | 6.7 | 67.7 | — | 1.5 | 1095 | 9.9 | 0.5 | 5.0 | — |
| 11 | 25.6 | 5.7 | 68.7 | — | 1.6 | 1180 | 9.8 | 0.5 | 7.3 | — |
| 12 | 25.6 | 3.4 | 71.0 | — | 1.7 | 1115 | 9.5 | 0.5 | 7.0 | — |
| 13 | 18.6 | 24.1 | 57.3 | — | 1.1 | 1260 | 10.0 | 1.3 | 6.3 | −41 |
| 14 | 18.6 | 21.8 | 59.6 | — | 1.2 | 1215 | 9.3 | 0.9 | 7.3 | −67 |
| 15 | 18.6 | 17.6 | 63.8 | — | 1.4 | 920 | 7.0 | 0.5 | 4.5 | — |
| 16 | — | 35.3 | 34.7 | 30 | 0.98 | 1250* | 12.2 | 3.5 | 2.1 | — |
| 17 | — | 42.8 | 42.2 | 10 | 0.98 | 1375* | 6.9 | 3.6 | 1.9 | — |

Note (1) Measured as Rockwell superficial hardness and converted to Vickers hardness unless otherwise indicated with an asterisk (*).

EXAMPLE 5

The gaseous fuel-oxidant mixtures of the compositions shown in Table 6 were each introduced into a detonation gun to form a detonatable mixture having an atomic ratio of oxygen to carbon as also shown in Table 6. The coating powder was Sample A for Sample Coatings 1 through 4 and Sample B for Sample Coating 5.

TABLE 6

D-GUN PARAMETERS AND PROPERTIES OF COATINGS MADE FROM POWDER A OR B

| Sample Coating | Gaseous Fuel-Mixture (Vol %) $N_2$ | $C_3H_6$ | $C_2H_2$ | $O_2$ | Total Gas Flow ($ft^3$/min) | $O_2$ to C Atomic Ratio | Powder Feed Rate (gpm) | Vickers[1] Hardness ($kg/mm^2$) |
|---|---|---|---|---|---|---|---|---|
| 1 | 40 | — | 30.3 | 29.7 | 11.0 | 0.98 | 53.3 | 1080* |
| 2 | 42 | — | 29.3 | 28.7 | 11.0 | 0.98 | 53.3 | 1070 |
| 3 | 55 | — | 22.7 | 22.3 | 13.5 | 1.00 | 33.3 | 1000 |
| 4 | — | 25.6 | 16.6 | 57.8 | 13.5 | 1.05 | 53.3 | 1210 |
| 5 | 30 | — | 35.3 | 34.7 | 11.0 | 0.98 | 46.7 | 1250* |

| Sample Coating | Chemistry % Co | % C | Strain-to-Fracture (mils/in) | Residual Stress (KSI) | Run-out Stress[2] at 10 Cycles with Unpeened Bar (KSI) | Run-out[3] Stress at $10^7$ Cycles with Peened Bar (KSI) |
|---|---|---|---|---|---|---|
| 1 | 13.2 | 3.5 | 2.9 | −2 | 30 | 47 |
| 2 | 14.5 | 3.5 | 3.5 | — | 52 | — |
| 3 | 16.6 | 3.4 | 4.8 | −27 | 72 | 71 |
| 4 | 14.1 | 2.8 | 5.9 | −35 | 86 | 110 |
| 5 | 12.2 | 3.5 | 2.1 | −3 | 31 | — |

[1]Measured as Rockwell superficial hardness and converted to Vickers hardness unless otherwise indicated with an asterisk (*).
[2]Run-out stress for uncoated and unpeened bar was 89 KSI
[3]Run-out for uncoated and peened bar was 93 KSI

What is claimed:

1. A coated article comprising a substrate coated with a tungsten carbide-cobalt layer having a strain-to-fracture greater than $4.3\times10^{-3}$ inch per inch and a Vickers hardness of greater than about 875 $HV_{0.3}$.

2. The coated article of claim 1 wherein the tungsten carbide-cobalt layer has a strain-to-fracture from about $4.5\times10^{-3}$ to $10\times10^{-3}$ inch per inch and a Vickers hardness of greater than about 900 $HV_{0.3}$.

3. The coated article of claim 1 wherein the tungsten carbide cobalt layer has a strain-to fracture greater than $5.3\times10^{-3}$ inch and a Vickers hardness of greater than about 1000 $HV_{0.3}$.

4. The coated article of claim 1, 2 or 3 wherein the tungsten carbide-cobalt layer is from about 0.0005 to about 0.1 inch thick.

5. The coated article of claim 4 wherein the tungsten carbide cobalt layer is from about 0.001 to about 0.02 inch thick.

6. The coated article of claim 1, 2 or 3 wherein the tungsten carbide-cobalt layer has a cobalt content of from about 7 to about 20 weight percent, a carbon content from about 0.5 to about 5 weight percent and tungsten content of from about 75 to 92.5 weight percent.

7. The coated article of claim 6 wherein said layer contains up to 6 weight percent chromium.

8. The coated article of claim 7 wherein said layer contains from about 3 to about 5 weight percent chromium.

9. The coated article of claim 8 wherein said layer contains about 4 weight percent chromium.

10. The coated article of claim 6 wherein the cobalt content is from about 8 to about 18 weight percent, the carbon content is from about 2.0 to about 4.0 weight percent and the tungsten content is from about 78 to about 90 weight percent.

11. The coated article of claim 6 wherein said substrate is selected from the group consisting of titatium, steel, aluminum, nickel, cobalt and alloys thereof.

12. The coated article of claim 6 wherein the cobalt content is about 9 to about 15 weight percent, the carbon content is about 2.5 to about 4.0 weight percent and the tungsten content is about 81 to about 88.5 weight percent, and wherein the substrate is a titanium based alloy.

13. The coated article of claim 6 wherein said layer contains up to 6 weight percent chromium and wherein said substrate is selected from the group consisting of titanium, steel, aluminum, nickel, cobalt and alloys thereof.

14. The coated article of claim 6 wherein said layer contains up to 6 weight percent chromium and wherein said substrate is a titanium based alloy.

15. The coated article of claim 1, 2 or 3 wherein said substrate is selected from the group consisting of titanium, steel, aluminum, nickel, cobalt and alloys thereof.

* * * * *

UNITED STATES PATENT AND TRADEMARK OFFICE

CERTIFICATE OF CORRECTION

PATENT NO. : 4,826,734

DATED : May 2, 1989

INVENTOR(S) : John E. Jackson

It is certified that error appears in the above-identified patent and that said Letters Patent is hereby corrected as shown below:

Col. 2, line 44 "$(C_3H_3)$" should read ---$(C_3H_8)$---

Col. 3, line 53 "cobalt" should read ---carbon---

Col. 5, line 22 "0 382" should read ---0.382---

Col. 10, line 37 "fuel oxidant" should read ---fuel-oxidant---

Col. 11, line 17 "fuel oxidant" should read ---fuel-oxidant---

Col. 11, line 26 "strain to frac-" should read ---strain-to-frac- ---

Col. 13, claim 3, line 40 "carbide cobalt" should read ---carbide-cobalt---

UNITED STATES PATENT AND TRADEMARK OFFICE

CERTIFICATE OF CORRECTION

PATENT NO. : 4,826,734

DATED : May 2, 1989

INVENTOR(S) : John E. Jackson

It is certified that error appears in the above-identified patent and that said Letters Patent is hereby corrected as shown below:

Col. 13, claim 5, line 47 "carbide cobalt" should read ---carbide-cobalt---

Signed and Sealed this

Third Day of October, 1989

*Attest:*

*Attesting Officer*

DONALD J. QUIGG

*Commissioner of Patents and Trademarks*